US007100585B2

(12) United States Patent
Bourret et al.

(10) Patent No.: US 7,100,585 B2
(45) Date of Patent: Sep. 5, 2006

(54) METHOD AND DEVICE FOR DIAGNOSING THE OPERATING CONDITION OF AN INTERNAL COMBUSTION ENGINE EXHAUST GAS RECYCLING VALVE

(75) Inventors: Stephane Bourret, Corbreuse (FR); Laurent Leprieur, Limours (FR); Olivier Meurisse, Antony (FR)

(73) Assignee: Renault S.A.S., Boulogne Billancourt (FR)

( * ) Notice: Subject to any disclaimer, the term of this patent is extended or adjusted under 35 U.S.C. 154(b) by 0 days.

(21) Appl. No.: 10/504,142

(22) PCT Filed: Feb. 25, 2003

(86) PCT No.: PCT/FR03/00601

§ 371 (c)(1),
(2), (4) Date: Feb. 22, 2005

(87) PCT Pub. No.: WO03/071121

PCT Pub. Date: Aug. 28, 2003

(65) Prior Publication Data

US 2005/0145231 A1 Jul. 7, 2005

(51) Int. Cl.
*F02B 47/08* (2006.01)
*F02B 47/00* (2006.01)

(52) U.S. Cl. ..... 123/568.16; 123/568.11

(58) Field of Classification Search ..... 123/568.16, 123/568.11; 73/117.3
See application file for complete search history.

(56) References Cited

U.S. PATENT DOCUMENTS

| | | | | |
|---|---|---|---|---|
| 5,184,594 | A * | 2/1993 | Saitoh et al. | 123/406.13 |
| 5,664,548 | A | 9/1997 | Izutani et al. | |
| 5,771,869 | A * | 6/1998 | Yoshihara et al. | 123/568.16 |
| 5,970,961 | A * | 10/1999 | Kotwicki et al. | 123/568.27 |
| 6,253,748 | B1 | 7/2001 | Engel et al. | |
| 6,837,226 | B1 * | 1/2005 | Wang et al. | 123/568.16 |

FOREIGN PATENT DOCUMENTS

| | | |
|---|---|---|
| EP | 0 812 983 | 12/1997 |
| EP | 0 837 237 | 4/1998 |
| EP | 0 884 466 | 12/1998 |
| FR | 2 753 488 | 3/1998 |
| JP | 62279261 | * 12/1987 |

OTHER PUBLICATIONS

Patent Abstract Of Japan, publication No. 62-279261.*

* cited by examiner

*Primary Examiner*—Mahmoud Gimie
(74) *Attorney, Agent, or Firm*—Oblon, Spivak, McClelland, Maier & Neustadt, P.C.

(57) ABSTRACT

A method for diagnosing the operating condition of an internal combustion engine exhaust gas recycling valve. The method acquires a measurement value of a reference position of the recycling valve at a predetermined time corresponding to a normally closed position of the valve, calculates the difference between the acquired reference value and a reference value acquired during a diagnostic cycle previously carried out, and compares the calculated difference with a threshold value for detecting opening of the valve.

10 Claims, 2 Drawing Sheets

METHOD AND DEVICE FOR DIAGNOSING THE OPERATING CONDITION OF AN INTERNAL COMBUSTION ENGINE EXHAUST GAS RECYCLING VALVE

BACKGROUND OF THE INVENTION

1. Field of the Invention

The present invention relates to a method for diagnosing the operating condition of an exhaust-gas recirculation valve of an internal combustion engine as well as to a corresponding diagnostic device.

2. Discussion of the Background

Motor vehicles, and especially motor vehicles of the diesel type, are often equipped with an exhaust-gas recirculation circuit intended to reinject the exhaust gases into the intake manifold of the engine.

It is known in fact that such recirculation makes it possible to lower the emissions of nitrogen oxide from the engine, which are particularly noxious chemical substances. The quantity of nitrogen oxide is closely related to the fuel-air composition of the reaction mixture in the engine cylinders and to the presence of inert gases.

Thus, by providing for recirculation of the exhaust gases, the inert gases are injected into the engine cylinders, thus making it possible to lower the quantity of nitrogen oxide produced by the engine.

However, such recirculation tends to cause a non-negligible increase in the quantity of smoke in the exhaust gases if this quantity is not correctly regulated and, in particular, if the quantity of recirculated exhaust gases is too large.

In addition, under certain conditions, especially when the driver of the motor vehicle requires abrupt acceleration, the exhaust-gas recirculation must be cut off.

Thus the exhaust-gas recirculation circuit is provided with a valve for control of the recirculated-gas flow. An electronic calculator having the task of managing the quantity of fuel to be injected into the engine cylinders activates the control valve in order to regulate the percentage of recirculated gases.

Traditionally, diagnosis or checking of proper operation of the exhaust-gas recirculation valve is achieved by comparing index values, supplied by the electronic calculator, of the fresh-air flow with measurements supplied by a corresponding flowmeter or alternatively by comparing the index position, supplied by the calculator, of the recirculation valve with a position measured by a measuring potentiometer.

It is considered that a malfunction occurs when the difference between a measured value and a corresponding index value is greater than a predetermined threshold value.

Information in this regard can be found in French Patent 2753488.

As regards monitoring of proper operation of the recirculation valve on the basis of comparison between an index value, supplied by the calculator, of fresh-air flow and a corresponding value measured by a flowmeter, this technique tends to generate false detections.

In fact, when the calculator requires closing of the valve, the index value of fresh-air flow becomes large and, if this index value is inadequately mapped in the calculator, the measured air flow cannot reach this index value. As a result, a persistent difference develops between the index value and the value of the measured air flow, which difference is interpreted by the calculator as a blockage of the valve in open position.

In addition, this technique tends to generate non-detections of malfunctions. In fact, when abrupt acceleration is demanded by the driver, the calculator requires cutoff of regulation of the quantity of recirculated gases, after which no regulation is performed as regards recirculation of the exhaust gases. Consequently, if the valve is not correctly closed, the calculator is not capable of detecting such a malfunction.

Such is also the case during a blockage of the valve in open position. In this case, the torque delivered by the engine drops. The driver may then demand abrupt acceleration to compensate for this loss of torque. If this acceleration demand is made before the diagnosis has been performed, the malfunction will not be detected.

As regards monitoring of proper operation of the exhaust-gas recirculation valve on the basis of checking of its position, the use of a potentiometer to measure the valve position means that the closed position of the valve must be learned, in order to allow for manufacturing tolerances of the valves and of the measuring potentiometers, the manufacturing tolerances of the valve being relatively large relative to those of the potentiometer. In addition, such learning is made necessary by the temperature sensitivity of the potentiometer and of the valve body, which leads to variation of the measurements of valve position as a function of temperature.

Such learning is generally achieved upon each engine start, before opening of the valve is authorized and before any regulation is undertaken, and thereafter upon each closing of the valve, in order to take into consideration how the position corresponding to the closed valve evolves as a function of temperature.

Although checking of proper operation of the valve on the basis of comparison between a measurement of valve position and an index position makes it possible to minimize the risks of false detections, inasmuch as the maximum closed position of the valve can be easily acquired, this technique suffers from major disadvantages as regards non-detections of malfunctions, inasmuch as the overall reaction time of the device in response to a close-valve command can be shorter than the time to diagnose a malfunction.

BACKGROUND OF THE INVENTION

The object of the invention is therefore to alleviate the aforesaid disadvantages.

Thus, according to the invention, there is proposed a method for diagnosing the operating condition of an exhaust-gas recirculation valve of an internal combustion engine, comprising acquisition of a measured value of a reference position of the recirculation valve at a predetermined moment corresponding to a normally closed position of the valve, calculation of the difference between the acquired reference value and a reference value acquired during a previously completed diagnostic cycle, and comparison of the calculated difference with a threshold value for detection of opening of the valve.

In this way, with each acquisition of the closed position of the valve, it is verified that the said valve is effectively closed.

According to one embodiment of this method, there is additionally calculated, following the step of acquisition of the reference value, the difference between the reference value acquired during a current diagnostic cycle and a reference value corresponding to a new recirculation valve of the same type, and the calculated difference is compared with a threshold value for detection of a malfunction of the valve.

Preferably, the reference value corresponding to a new recirculation valve of the same type is acquired during the first start of the engine.

Preferably, the values of the detection threshold for opening and malfunction each include a first term that is variable as a function of temperature and a second term corresponding to a detection threshold that is independent of temperature.

According to another characteristic of this method, the said threshold values are variable as a function of operating parameters of the engine.

The reference value acquired during the diagnostic cycle in progress is additionally stored in memory in view of a subsequent diagnostic cycle, if correct closing of the valve and the absence of malfunctions were detected during that diagnostic cycle.

According to the invention, there is also proposed a device for diagnosing the operating condition of an exhaust-gas recirculation valve of an internal combustion engine, for use of a method such as described hereinabove.

This device is provided with means for measuring the valve position, the said means being connected to a central processing unit in order to deliver thereto a measured value of the reference position of the valve, the central unit being provided with means for calculating the difference between the reference value and a reference value acquired during a previously completed diagnostic cycle, and with means for comparing the calculated difference with a threshold value for detection of opening of the valve.

According to another characteristic of this device, the central unit is provided with means for calculating the difference between the reference value and a reference value corresponding to a new recirculation valve of the same type and with means for comparing the calculated difference with a threshold value for detection of a malfunction of the valve.

For example, the means for measuring the valve position contain a measuring potentiometer.

BRIEF DESCRIPTION OF THE DRAWINGS

Other objects, characteristics and advantages of the invention will become evident from the description hereinafter, given solely by way of non-limitative example, with reference to the attached drawings, wherein.

DETAILED DESCRIPTION OF THE PREFERRED EMBODIMENTS

Figure 1:
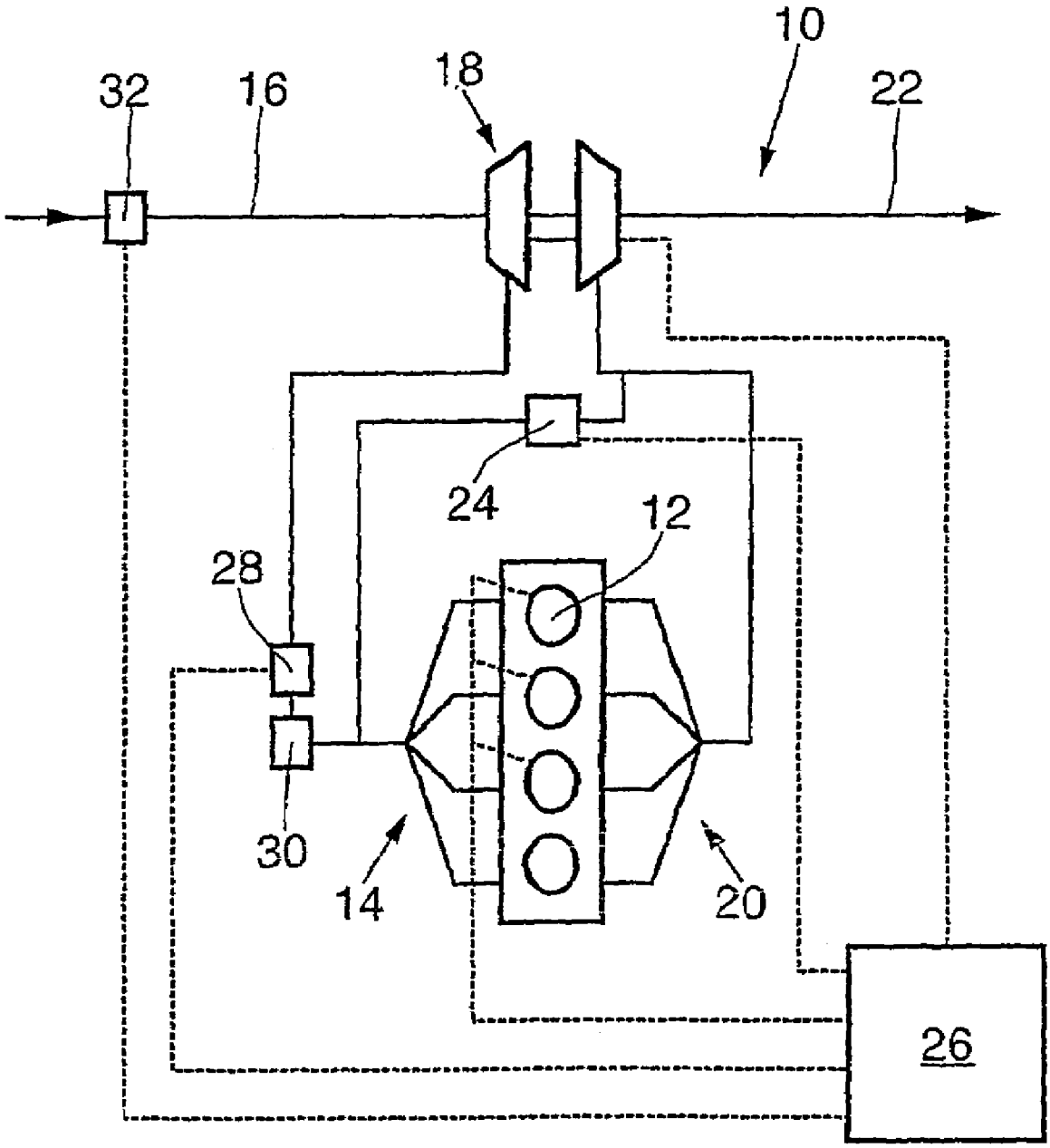
FIG. 1 is a schematic view of an internal combustion engine equipped with an exhaust-gas recirculation circuit and provided with a device according to the invention for diagnosing the operating condition of the valve of the recirculation circuit.

FIG. 1 schematically illustrates the general structure of an internal combustion engine of a motor vehicle, denoted by the general numerical reference 10.

In the practical example under consideration, engine 10 is provided with four cylinders 12 in line.

Cylinders 12 are supplied with air via an intake manifold 14, which itself is supplied by a pipe 16 provided with an air filter (not illustrated) and with a turbocompressor 18 for supercharging the engine with air.

An exhaust manifold 20 recovers the exhaust gases discharged from combustion and evacuates them to the outside, via the turbocompressor and via an exhaust line 22.

The exhaust-gas recirculation circuit, comprising one portion of the circuit for supplying the engine with air and one portion of the exhaust circuit, functions to reinject part of the exhaust gases into intake manifold 14, in such a manner as, in particular, to limit the quantity of nitrogen oxide produced while preventing the formation of smoke in the exhaust gases.

This recirculation circuit comprises substantially an exhaust-gas recirculation valve, denoted by the general numerical reference 24.

In addition, engine 10 is provided with a calculator 26, duly programmed to check the operation of engine 10, and in particular to ensure adjustment of its operating parameters and to run a diagnosis of the operation of recirculation valve 24.

For this purpose, central unit 26 is connected to a set of sensors such as, in particular, a supercharging pressure sensor 28, a temperature sensor 30 for the air admitted into intake manifold 14, and a flow sensor 32 disposed in supply conduit 16.

As regards diagnosis of the operating condition of recirculation valve 24, the latter is provided with a measuring potentiometer (not illustrated) for measurement, between the open and closed position, of angular displacement of the valve in the case of a flap valve or of linear displacement of the said valve in the case of a lift valve.

Central unit 26 contains, stored in memory, threshold values for detection of opening of the valve as well as threshold values for detection of malfunctions, and it incorporates all necessary software means for ensuring, on the one hand, activation of the valve to obtain an optimized quantity of recirculated gases and, on the other hand, checking of closing of the valve or detection of a blockage preventing opening of the said valve and, in general, detection of operating defects, as will now be described hereinafter.

Figure 2:
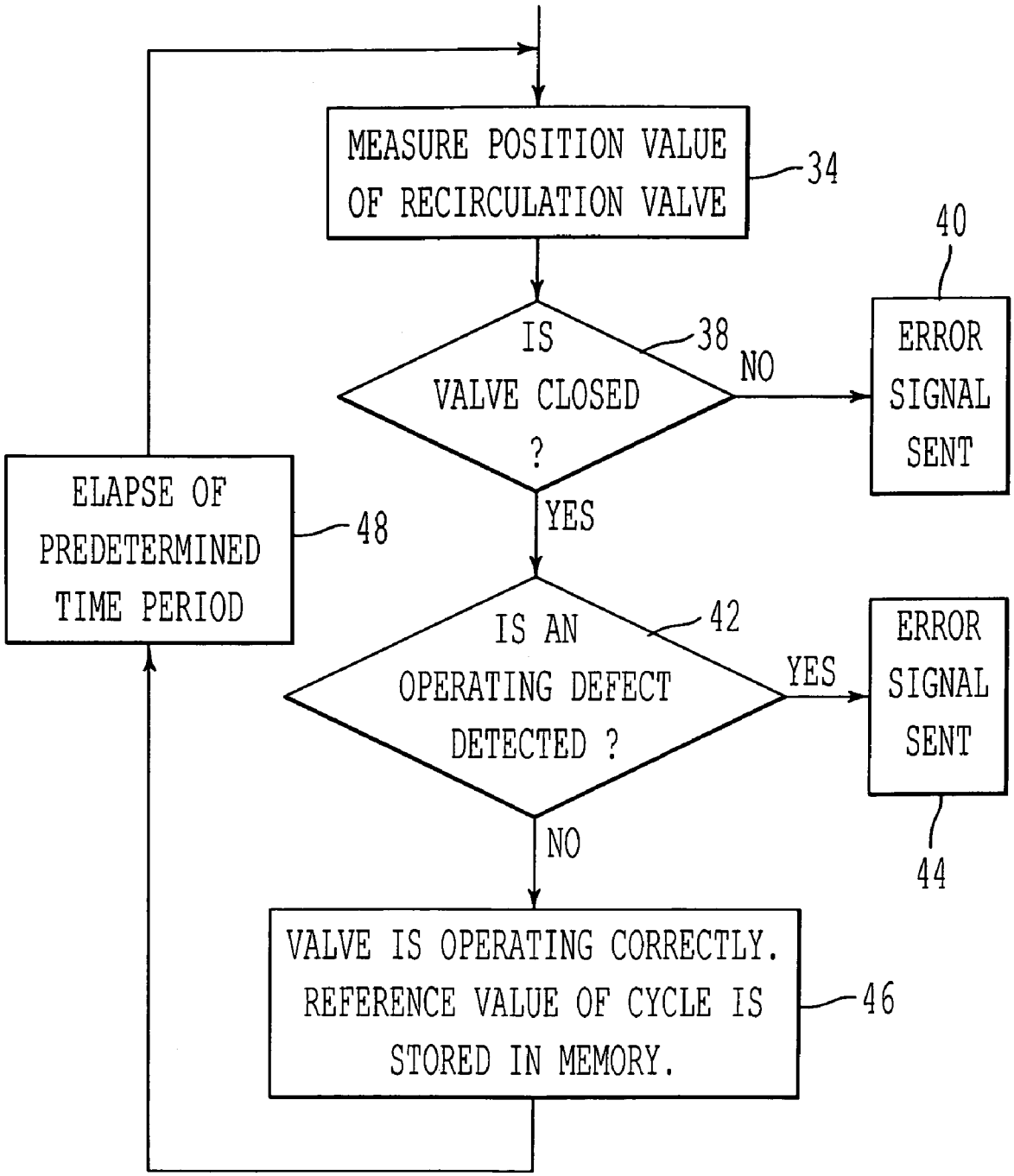
FIG. 2 is a flow diagram illustrating the main phases of the diagnostic method according to the invention.

In fact, referring now to FIG. 2, which illustrates a cycle for diagnosis of the operation of the valve, central unit 26 ensures during a first step 34 that a measured value of the position of the recirculation valve is acquired, in an operating zone in which the valve is normally closed.

As indicated hereinabove, this diagnostic cycle is run upon each engine start or upon each closing of the valve.

Consequently, this reference value, which is delivered by the measuring potentiometer with which the valve is provided, is acquired at a moment at which the valve is expected to be closed. It is acquired at the moment of engine start, before any open-valve command is authorized, and after each close-valve order, so as to compensate for expansions of the valve body and of the potentiometer caused by the effect of exhaust-gas temperature.

During the next step 38, blockage of the valve in open position is detected or, in other words, a check is run to determine whether the reference position corresponds to a closed position of the valve.

For this purpose, central unit 26 runs a calculation of the difference between the reference value acquired during the current diagnostic cycle and a reference value acquired during a previously completed diagnostic cycle corresponding to the absence of malfunction.

During this step, the difference calculated in this way is compared with a value of detection of opening of the valve.

Thus, if the value of the calculated difference is greater than this threshold value, a decision is made during the next step 40 that the valve is blocked and an error signal is transmitted.

It will be noted that, preferably, the threshold value used for detection of blockage of opening of recirculation valve 24 includes a first term that is variable as a function of exhaust-gas temperature and a second term that is independent of temperature.

If it is considered at the end of this diagnostic step 38 that the valve is effectively closed, a second diagnosis is run in the next step 42 in order to determine whether the valve is dirty or, in general, to detect any operating defect of the valve.

For this purpose, calculator 26 runs a calculation of the difference between the reference value acquired during this diagnostic cycle and a measured reference value corresponding to a new or cleaned valve of the same type. Preferably, this measured reference value is acquired during the first start of the engine.

It then runs a comparison of this calculated difference with a second threshold value for detection of whether the valve is dirty.

Consequently, if the calculated difference is greater than this threshold value, an error signal is transmitted during the next step 44 in order to indicate that the recirculation valve is dirty.

It will be noted that the threshold used to run this second diagnosis is also preferably composed of a first term that is variable as a function of temperature and a second term corresponding to a detection threshold that is independent of temperature.

It will also be noted that the thresholds indicated hereinabove for running the diagnosis of the operating condition of the valve are preferably composed of threshold values that are variable as a function of operating parameters of the engine, particularly as regards the second term.

As regards the first term, it can be worked up from a measurement of the temperature of the recirculated exhaust gases followed by processing within central unit 26.

In another version, as an alternative to the use of this first term that is variable as a function of temperature, it is also possible to undertake processing of the reference value acquired as a function of exhaust-gas temperature.

At the end of this second diagnostic step 42, if it is detected that the recirculation valve is effectively closed and that it is operating correctly, the reference value of the cycle in progress is stored in memory in the central unit in view of being used during a subsequent diagnostic cycle.

During the following step 46, the valve is commanded as a function of an index value delivered by central unit 26.

As indicted hereinabove, a new measured reference value is acquired upon each closing of the valve.

Thus, after each close-valve order transmitted by the calculator, the procedure returns to the aforesaid step 34, after expiration of a predetermined time period corresponding to the closing time of the valve (step 48).

The invention claimed is:

1. A method for diagnosing an operating condition of an exhaust-gas recirculation valve of an internal combustion engine, comprising:

acquiring a measured value of a reference position of a recirculation valve at a predetermined moment corresponding to a normally closed position of the valve;

calculating a difference between the acquired reference value and a reference value acquired during a previously completed diagnostic cycle; and comparing the calculated difference with a threshold value for detection of opening of the valve, wherein the calculating calculates, following the acquiring of the reference value, the difference between the reference value acquired during a current diagnostic cycle and a second reference value corresponding to a new recirculation valve of same type, and the calculated difference is compared with a threshold value for detection of a malfunction of the valve.

2. A method according to claim 1, wherein the second reference value corresponding to a new recirculation valve of same type is acquired during a first start of the engine.

3. A method according to claim 1, wherein the values of the detection threshold for opening and malfunction each include a first term that is variable as a function of temperature and a second term corresponding to a detection threshold that is independent of temperature.

4. A method according to claim 1, wherein the threshold values are variable as a function of operating parameters of the engine.

5. A method according to claim 1, wherein the reference value acquired during the current diagnostic cycle is stored in memory in view of a subsequent diagnostic cycle, if correct closing of the valve and an absence of malfunction were detected during the subsequent diagnostic cycle.

6. A device for diagnosing an operating condition of an exhaust-gas recirculation valve of an internal combustion engine, for use of a method according to claim 1, the device comprising:

means for measuring the valve position connected to a central processing unit to deliver the central processing unit a measured value of the reference position of the valve, the central processing unit comprising means for calculating a difference between the measured value and a reference value acquired during a previously completed diagnostic cycle, and means for comparing the calculated difference with a threshold value for detection of opening of the valve.

7. A device according to claim 6, wherein the central processing unit further comprises means for calculating the difference between the measured value and a second reference value corresponding to a new recirculation valve and means for comparing the calculated difference with a threshold value for detection of a malfunction of the valve.

8. A device according to claim 6, wherein the means for measuring the valve position includes a measuring potentiometer.

9. A device for diagnosing an operating condition of an exhaust-gas recirculation valve of an internal combustion engine, for use of a method for diagnosing an operating condition of an exhaust-gas recirculation valve of an internal combustion engine, comprising acquiring a measured value of a reference position of a recirculation valve at a predetermined moment corresponding to a normally closed position of the valve, calculating a difference between the acquired reference value and a reference value acquired during a previously completed diagnostic cycle, and comparing the calculated difference with a threshold value for detection of opening of the valve, the device comprising:

means for measuring the valve position connected to a central processing unit to deliver the central processing unit a measured value of the reference position of the valve, the central processing unit comprising means for calculating a difference between the measured value and a reference value acquired during a previously completed diagnostic cycle, and means for comparing the calculated difference with a threshold value for detection of opening of the valve, wherein the central processing unit further comprises means for calculating the difference between the measured value and a second reference value corresponding to a new recirculation valve and means for comparing the calculated difference with a threshold value for detection of a malfunction of the valve.

10. A device according to claim 9, wherein the means for measuring the valve position includes a measuring potentiometer.

* * * * *

UNITED STATES PATENT AND TRADEMARK OFFICE

CERTIFICATE OF CORRECTION

PATENT NO. : 7,100,585 B2
APPLICATION NO. : 10/504142
DATED : September 5, 2006
INVENTOR(S) : Bourret et al.

It is certified that error appears in the above-identified patent and that said Letters Patent is hereby corrected as shown below:

On the title page, Item (30), the Foreign application priority data has been omitted. Item (30) should read:

-- (30) Foreign Application Priority Data

Feb. 25, 2002 (FR)……...…..02-02362 --

Signed and Sealed this

Nineteenth Day of December, 2006

JON W. DUDAS
*Director of the United States Patent and Trademark Office*